United States Patent [19]

Brundage

[11] Patent Number: 4,579,220

[45] Date of Patent: Apr. 1, 1986

[54] SHIPPING AND DISPLAY CONTAINER

[75] Inventor: David J. Brundage, Salinas, Calif.

[73] Assignee: Champion International Corporation, Stamford, Conn.

[21] Appl. No.: 300,167

[22] Filed: Sep. 8, 1981

[51] Int. Cl.[4] ..... B65D 5/30; B65D 5/52

[52] U.S. Cl. ..... 206/45.25; 206/45.13; 206/45.14; 206/45.24; 206/45.3; 229/16 D

[58] Field of Search ..... 206/45.13, 45.14, 45.24, 206/45.25, 561, 45.29, 45.3; 229/16 D, 31 FS

[56] References Cited

U.S. PATENT DOCUMENTS

| | | | |
|---|---|---|---|
| 939,234 | 11/1909 | Eichhorn | 229/16 D |
| 1,799,656 | 4/1931 | Tinsley | 206/45.14 |
| 1,866,211 | 7/1932 | Hines | 206/45.3 |
| 3,009,565 | 11/1961 | Leone | 206/45.14 |
| 3,340,998 | 9/1967 | Wilson | 206/44 R |
| 3,531,041 | 9/1970 | Rohde | 229/31 FS |
| 3,545,665 | 12/1970 | Nimaroff | 229/31 FS |

*Primary Examiner*—George E. Lowrance
*Assistant Examiner*—Brenda J. Ehrhardt
*Attorney, Agent, or Firm*—Evelyn M. Sommer

[57] ABSTRACT

A shipping and display container which is formed from a one piece blank and which is folded along predetermined fold lines to form a tray portion and a cover portion hingedly connected to each other. The tray portion may be provided with compartments to receive packages therein. The cover portion is adapted to be folded back beneath the tray so that the tray may be supported at an angle with respect to a support surface in order to display the contents of the tray. In the open position, the tray has provision for an upright display panel to be attached thereto.

3 Claims, 10 Drawing Figures

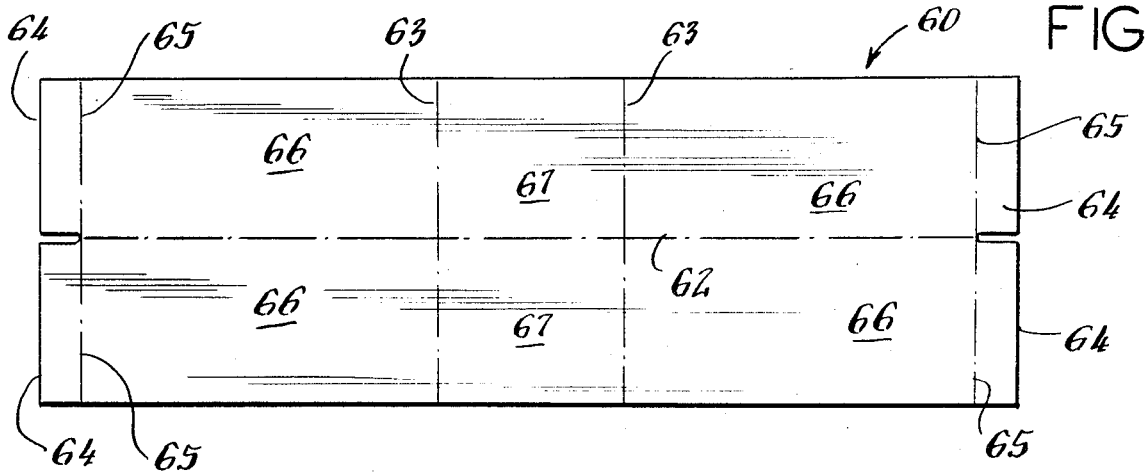
FIG. 2
FIG. 7
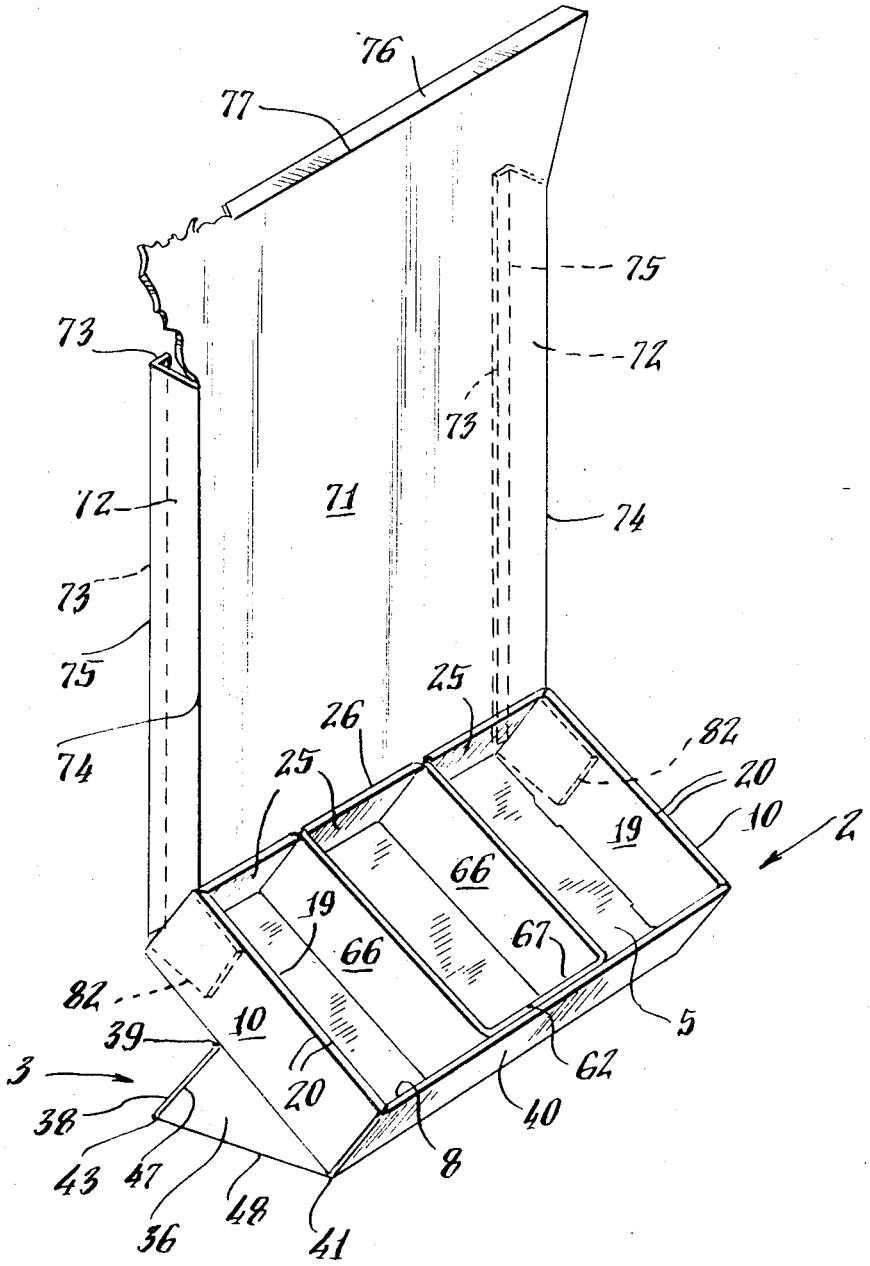

SHIPPING AND DISPLAY CONTAINER

BACKGROUND OF THE INVENTION

The present invention is directed to a one piece shipping and display container which is adapted to be closed for shipping purposes and to be opened for display purposes.

In the past, containers have been used for both shipping and display purposes. However, some of said containers are usually two piece containers comprising a tray and a removable cover. Other containers which have covers hinged to the trays are awkward to use as display containers because the tray must fit into the cover and the tray and cover tilted at an angle to the support surface to display the contents of the tray. A separate support, e.g., an upright wall is often used to support the tray and cover in a tilted attitude.

The present invention overcomes these drawbacks and has for one of its objects the provision of an improved shipping and display container which is made from a one piece blank and which may be easily used for both display purposes and for shipping purposes.

Another object of the present invention is the provision of an improved shipping and display carton which has means for permitting the hinged cover to be folded back beneath the tray to support the tray at an accute angle with respect to a support surface to display the contents of the tray.

Another object of the present invention is the provision of an improved shipping and display container in which a partition may be used with the tray to permit the articles to be displayed to be separated.

Another object of the present invention is the provision of an improved shipping and display container which may be used with a display poster for advertising the articles in the tray.

Other and further objects of the invention will be obvious upon an understanding of the illustrative embodiment about to be described, or will be indicated in the appended claims, and various advantages not referred to herein will occur to one skilled in the art upon employment of the invention in practice.

BRIEF DESCRIPTION OF THE INVENTION

Briefly, the present invention comprises a one piece roll-end tray with roll-side front flaps that has a hinged cover with a roll-side front which telescopes over the top of the tray and most of the sides and the front of the tray. The hinged cover has an extra fold line in it that enables it to fold 270° backwardly beneath the bottom of the tray and tapering side walls which extend from the front of the cover to the extra fold line so that when it is inverted, the tray is caused to assume a 40° attitude with respect to a horizontal support surface to display articles within the tray. A separate, U-shaped partition which locks into the front flaps of the tray may be used to enable the tray to be divided into three equal parts, while a separate upright display poster may be attached to the inclined tray.

BRIEF DESCRIPTION OF THE DRAWINGS

A preferred embodiment of the invention has been chosen for purposes of illustration and description and is shown in the accompanying drawings forming a part of the specification, wherein:

FIG. 2 is a plan view of a partition blank from which a partition for use with the present invention may be made.

FIG. 7 is a perspective view showing the container in its open display posiition with a display panel mounted thereon.

DETAILED DESCRIPTION OF THE REFERRED EMBODIMENT

Figure 1:
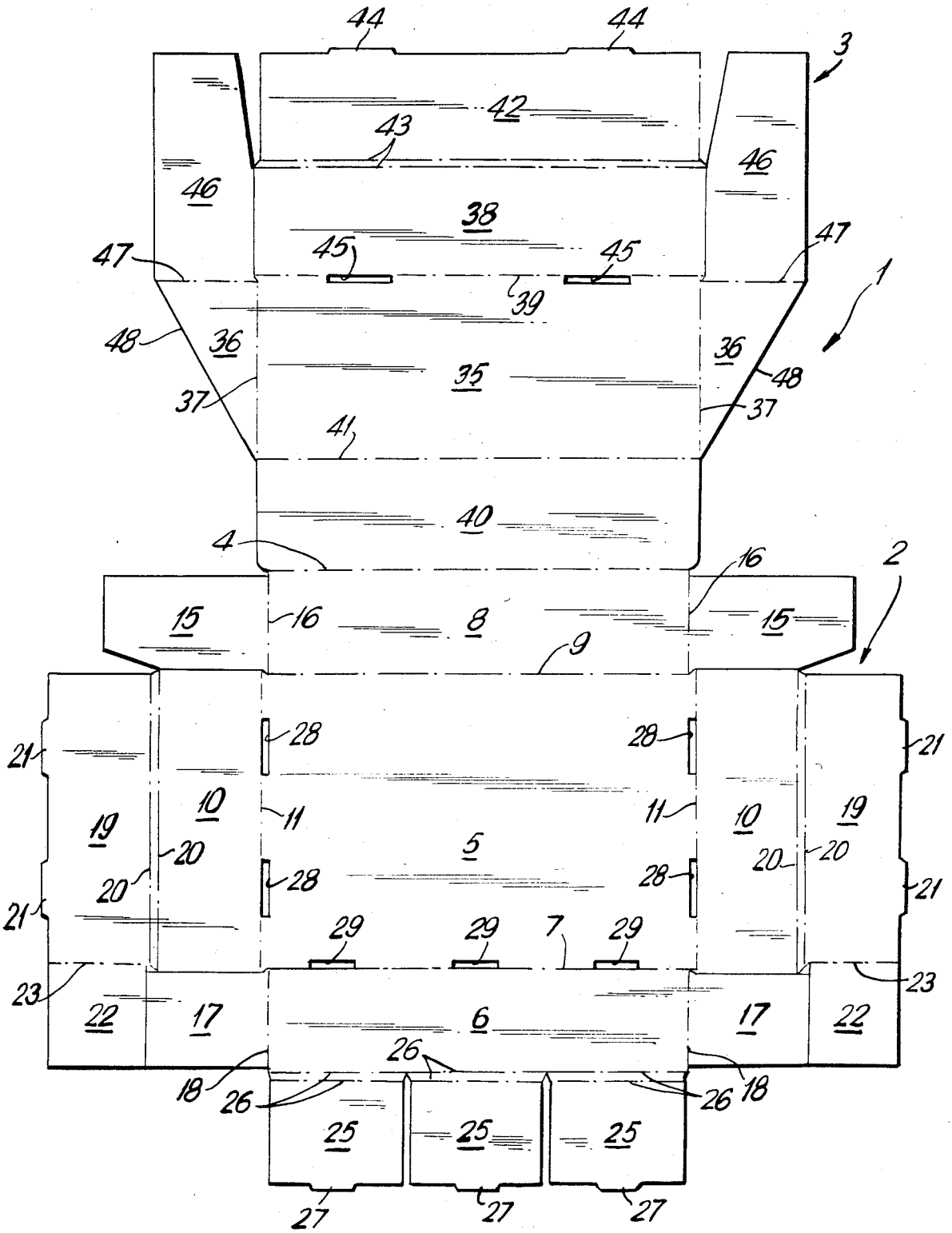
FIG. 1 is a plan view of a container blank from which the container of the present invention may be made.

Referring to the drawings and more particularly to FIG. 1 thereof, the combined display and shipping container 1 of the present invention is preferably made from a one piece container blank which may be made of a fiberboard material, or some other suitable material, and which may be die-cut by standard automatic machinery, as is well known in the trade. The blank 1 comprises a tray assembly portion 2 and a cover assembly portion 3 hingedly connected to the tray assembly 2 by a connecting fold line 4. The tray assembly portion 2 comprises a bottom wall panel 5, a front wall panel 6 hingedly connected to bottom wall panel 5 by a fold line 7, a rear wall panel 8 hingedly connected to bottom wall panel 5 by a fold line 9 and a pair of side wall panels 10 hingedly connected to the bottom wall panel 5 by fold lines 11.

The rear wall panel 8 has a rear end flap 15 extending from each end edge thereof and foldably connected thereto by a fold line 16. The front wall panel 6 has a front end flap 17 extending from each end edge thereof and foldable relative thereto along a fold line 18. Each side wall panel 10 has a side lock flap 19 extending therefrom and foldable relative thereto along a pair of adjacent parallel fold lines 20. Each of the side lock flaps 19 is provided with a plurality of lock tabs 21 and with a side end flap 22 extending from one end edge thereof and foldable relative thereto along a fold line 23.

Extending from the front wall panel 6 is a plurality of spaced front lock flaps 25 which are independently movable relative to each other and which are foldable relative to the front wall panel 6 along adjacent parallel fold lines 26. Each front lock flap 25 has a lock tab 27 extending therefrom.

The bottom wall panel 5 has a plurality of slit-and-crush slots 28 and 29 along fold lines 11 and 7, respectively, which are adapted to receive and securely hold the lock tabs 21 and 27, respectively, of the side lock flaps 19 and the front lock flaps 25, respectively, when the tray 2 is assembled.

The cover assembly portion 3 of the blank 1 comprises a top wall panel 35 having a pair of side wall panels 36 extending from and hingedly connected thereto by fold lines 37. A front wall panel 38 extends from and is hingedly connected to the top wall panel 35 by a fold line 39. The top wall panel 35 has an extra top fold line 41 therein parallel to the connecting fold line 4 to form a rear top wall portion 40 hingedly connected to the top wall panel 35 along said top fold line 41 with the rear top wall portion 40 hingedly connected to the rear wall 8 of the tray 2 by the connecting fold line 4. The said top rear portion 40 is approximately the same width as the width of the rear wall panel 8 of the tray 2.

The front wall panel 38 has a lock flap 42 extending therefrom and hingedly connected thereto along a pair of adjacent parallel fold lines 43. The lock flap 42 has a pair of lock tabs 44 extending therefrom which are adapted to be inserted in the slit-and-crush slots 45 forward in the top wall panel 38 along fold line 39.

Each side wall panel 36 has an end flap 46 extending therefrom and foldable relative thereto along a fold line 47. Each side wall 36 terminates short of the connecting fold line 4 and preferably terminates at the top fold line 41. The outer edge 48 of each side wall panel 36 is tapered outwardly extending from the top fold line 41 to the outer end of the fold line 47 of the end flaps 46 to form a wedge-shaped side wall 36.

Figure 4:
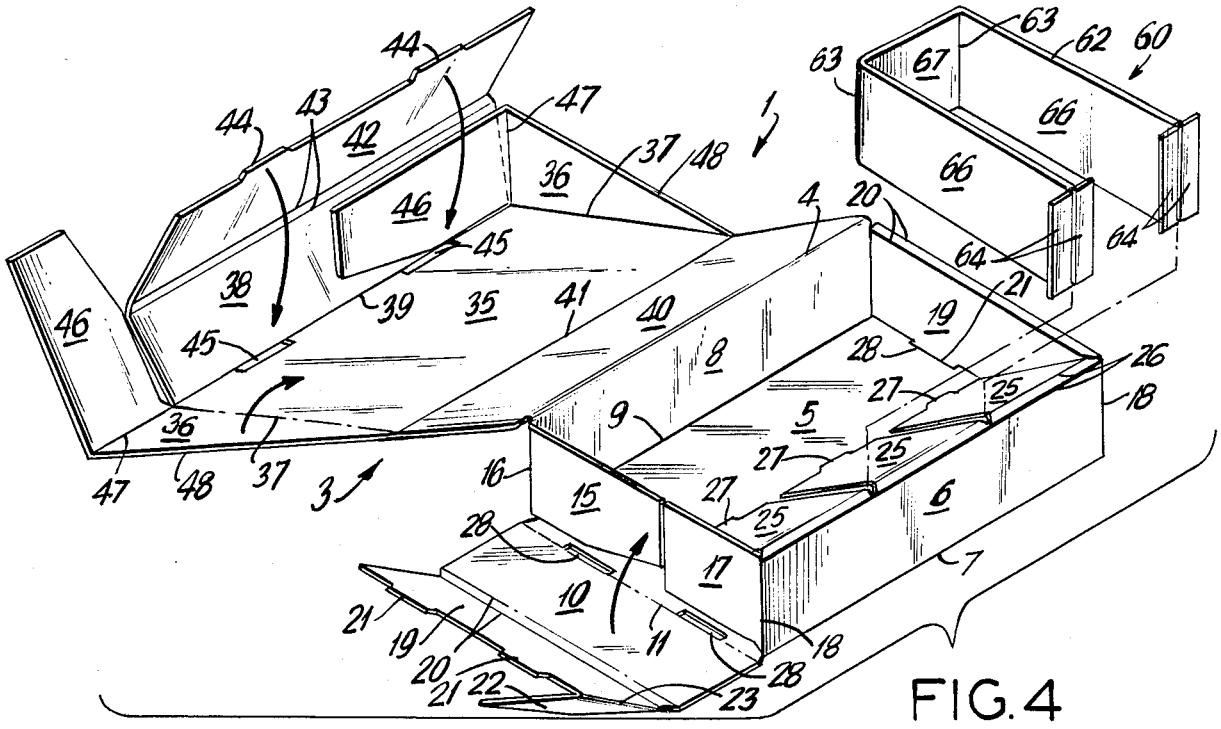
FIG. 4 is an exploded perspective view showing the container of the present invention in a partially assembled condition.
Figure 5:
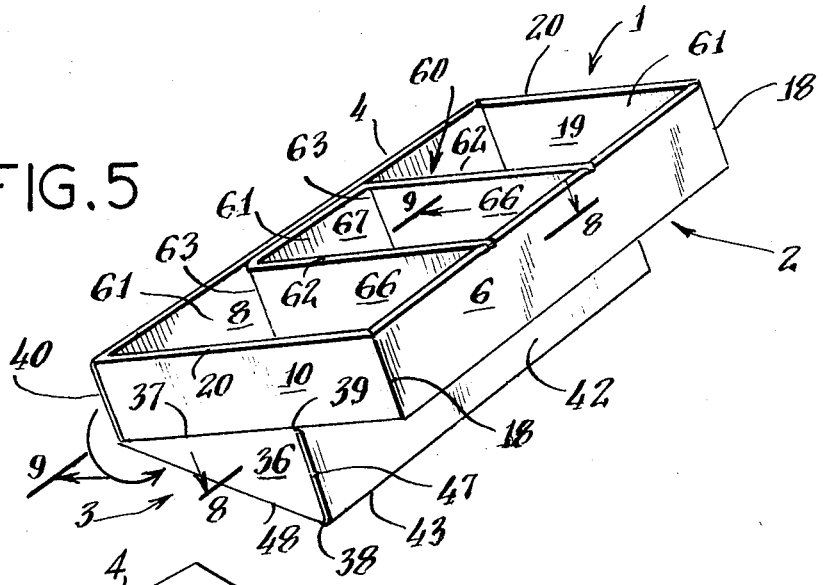
FIG. 5 is a perspective view showing the assembled container of the present invention in its open display position.

Referring to FIG. 4, when the container 1 is to be assembled, the tray 2 is formed by folding front wall panel 6 and rear wall panel 8 upwardly along the fold lines 7 and 9, respectively, to an upstanding position. The end flaps 15 and 17 of rear and front wall panels 8 and 6, respectively, are then folded inwardly along fold lines 16 and 18, respectively, at right angles to their respective rear and front wall panels 6 and 8. The lock flaps 19 of the side walls 10 are then folded over the end flaps 15 and 17 along the fold lines 20 so that they assume a position adjacent the inner faces of end flaps 15 and 17 with their lock tabs 21 inserted into the slit-and-crush slots 28 to hold the end walls 10 in upright position.

The side end flaps 22 of the lock flaps 19 are folded outwardly so that they lie adjacent the inner face of the front wall 6. The front lock flaps 25 are then folded along fold lines 26 over the side end flaps 22 so that they are adjacent to the inner faces of the side end flaps 22 and the lock tabs 27 are inserted into their respective slit-and-crush slots 29 to lock the front wall 6 in place and complete the construction of the tray portion 2.

The cover portion 3 is formed by folding the side wall panels 36 inwardly along fold lines 37 and folding their respective end flaps 46 inwardly along the fold lines 47 so that side wall panels 36 and end flaps 46 assume an upstanding position. The front wall panel 38 is folded upwardly along fold line 39 and its lock flap 42 is then folded over the end flaps 46 along fold lines 43 until the lock tabs 44 are inserted into the slit-and-crush slots 45 to lock the front wall 38 in upright position and complete the cover 3.

Figure 6:
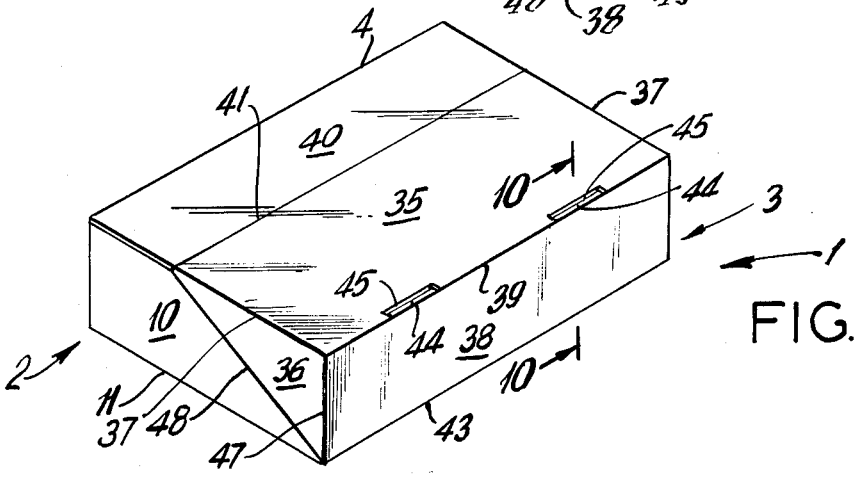
FIG. 6 is a perspective view showing the container of the present invention in its closed shipping or storage position.

With this construction, the cover 3 may be folded over the tray 2 along the connecting fold line 4 to close the container as illustrated in FIG. 6. The side walls 36 and the front wall 38 of the cover 3 will telescope over and lie adjacent the outer surfaces of the side walls 10 and front wall 6 of the tray 2. In this position, the container 1 may be sealed by any suitable means and shipped or stored until it is to be used.

When the container 1 is to be opened and used as a display, the cover 3 is folded back along the connecting fold line 4 and the top rear portion 40 of the top wall 35 is folded back down along the top fold line 41. This is possible because the side walls 36 of the cover 3 terminate at the top fold line 41 and permit said top rear portion to be bent backwardly. The top rear portion 40 of the cover is bent along top fold line 41 until it lies substantially adjacent, and preferably parallel, to the outer surface of the rear wall 8 of the tray 2 and along the outer surface thereof. Cover portion 35 along with tapered side walls 36 and wall panel 38 is then rotated an additional 180° so that, top wall 35 abuts bottom wall 5 of tray 2. The outer edges 48 of each tapered side wall 36 will rest on a horizontal support surface and tilt the tray 2 forwardly at an angle of approximately 40° to display the interior of tray 2.

Figure 8:
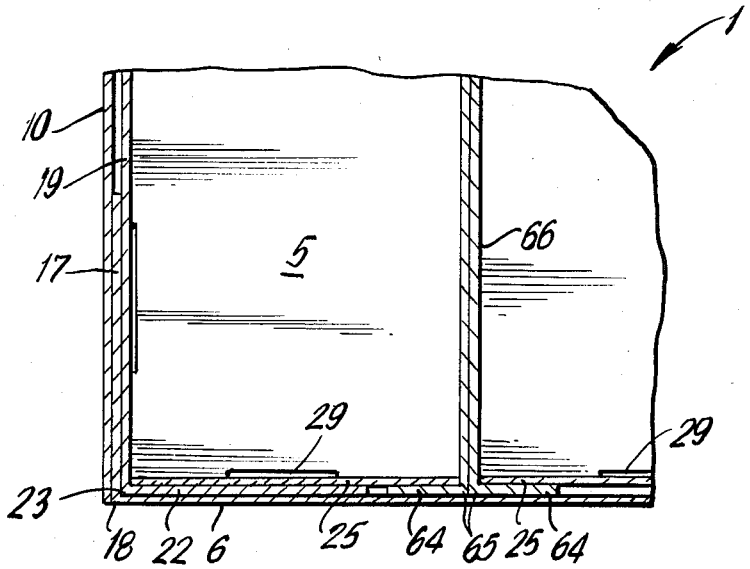
FIG. 8 is a sectional view taken along line 8—8 of FIG. 5.
Figure 9:
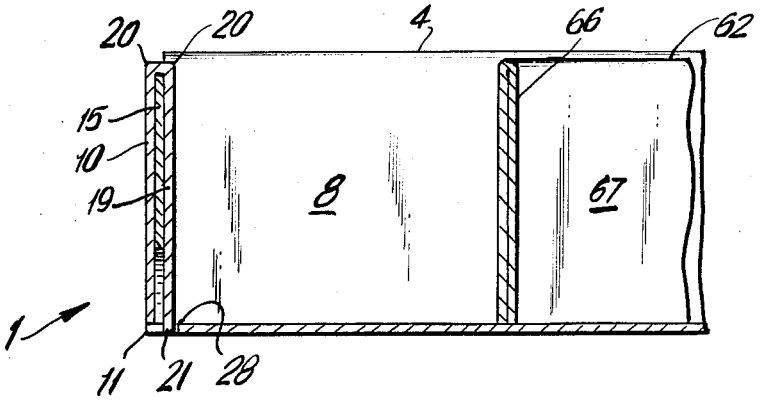
FIG. 9 is a sectional view taken along line 9—9 of FIG. 5.
Figure 10:
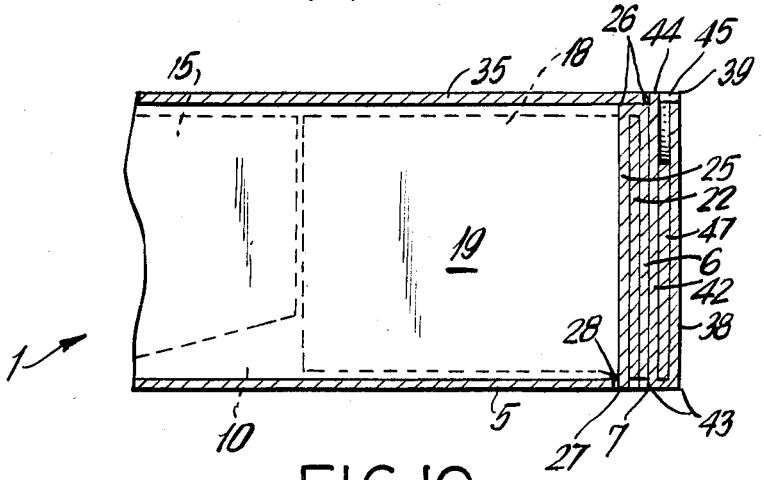
FIG. 10 is a sectional view taken along line 10—10 of FIG. 6.

The interior tray 2 is adapted to receive articles (not shown) for display purposes. If desired, a U-shaped partition assembly 60 may be used to separate the tray 2 into three compartments 61. As shown in FIG. 2, the partition 60 is preferably made from a blank 60 adapted to be folded longitudinally along a fold line 62 and transversely along a pair of spaced fold lines 63 to form the U-shaped partition 60 having leg portions 66 and base portion 67. The end edges of the blank 60 have a pair of spaced lock flaps 64 extending outwardly therefrom and foldable relative thereto in opposite directions with respect to the leg portions 66 along fold lines 65 (FIG. 4). The base 67 lies adjacent rear wall 8 and the lock flaps 64 are inserted beneath the spaced lock flaps 25 on the front wall 6 of the tray 2 (FIGS. 4 and 8) in order to hold portion 60 in place. Thus, the partition 6 separates the tray 2 into three compartments 61, each of which may receive articles. However, it will be understood that the partition 60 may be eliminated, without departing from the invention, in which event the lock flaps 25 may be made in one piece rather than the three pieces shown.

Figure 3:
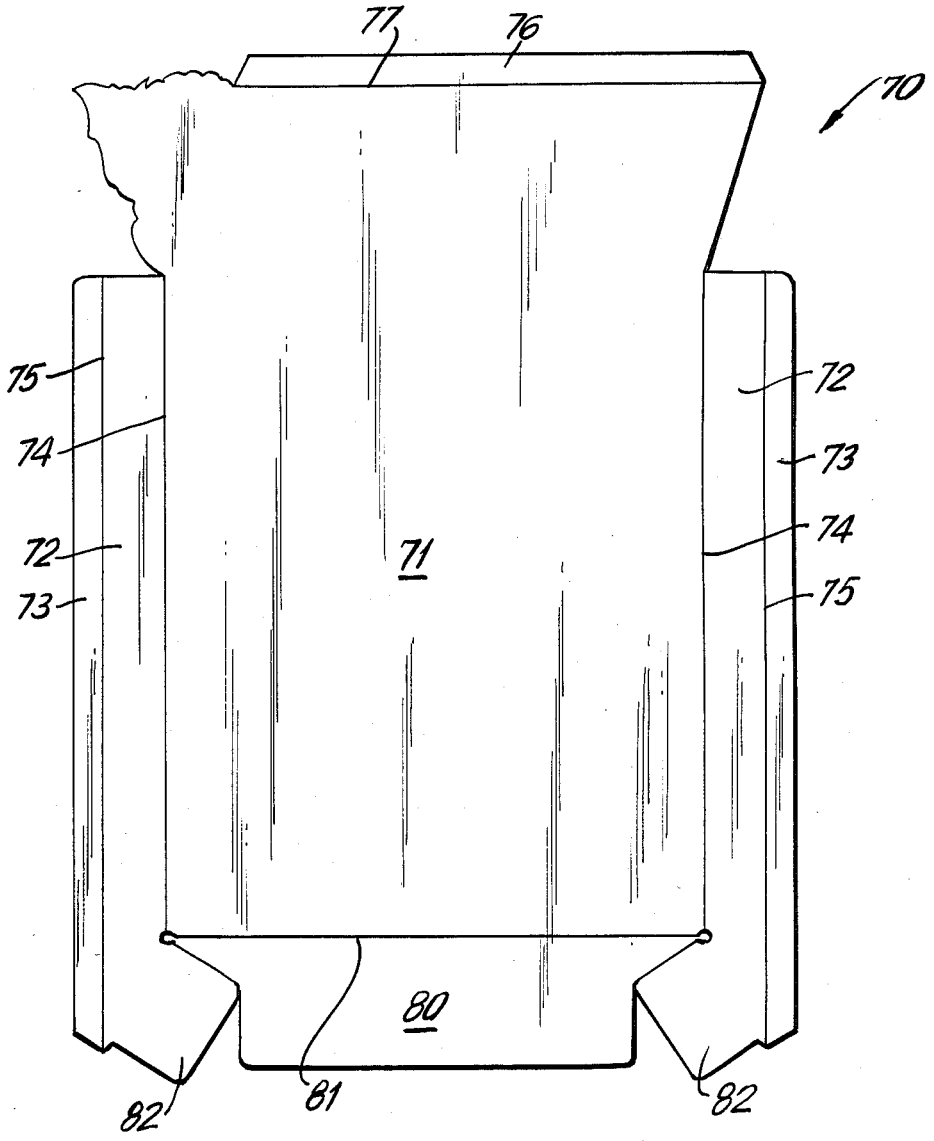
FIG. 3 is a plan view of a display panel blank from which a display panel for use in accordance with the present invention may be made.

Referring to FIG. 7, the display container 1 may be used with an upstanding display poster 70 which may have indicia thereon for advertising the goods that are being displayed in the tray 2. As shown in FIG. 3, the poster 70 may be formed from a blank having a main body panel 71 on which the advertising indicia may be printed. A pair of side panels 72 extend from each side edge thereof and are foldable relative thereto along fold lines 74. A side flap 73 extends from each side panel 72 and is foldable relative thereto along a fold line 75. A top flap 77 and a bottom support panel 80 extends from the main body panel 77 and are foldable relative thereto along fold lines 77 and 81, respectively. The lower end of each side panel 72 is formed into a holding flap 82 extending inwardly and downwardly therefrom.

When in use, the support panel 80 may be placed in abutment with the outer surface of front wall 6 of tray 2 and the holding flaps 82 inserted between the panels of the side walls 10 to permit the display poster 70 to be held in place in an upright position. However, it will again be understood that the display poster 70 may be eliminated without departing from the present invention.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A container comprising a tray portion and a cover portion, said cover portion being hingedly connected to said tray portion along a connecting fold line, said tray portion comprising a bottom wall, tray side walls, a tray front wall and a tray rear wall, said cover portion comprising a top wall, cover side walls and a cover front wall, the cover side walls terminating short of said connecting fold line, said top wall being provided with a top fold line parallel to and spaced from said connecting fold line to form a top rear portion, said cover side walls having outer edges tapering outwardly from said top fold line and end flaps extending therefrom and foldable relative thereto inwardly to lie adjacent said front cover wall, and said front cover wall having a flap extending therefrom and extending over said cover side wall end flaps, wherein said top rear portion is adapted to be folded backwardly to a position substantially adjacent and parallel to the outer surface of the tray rear wall, and said top wall folded about said top fold line beneath the bottom wall of the tray to support the same at an angle to a supporting surface along the outer edges of said cover side walls, said tray front wall including a lock flap assembly which comprises a plurality of spaced and independently movable tray front wall lock flaps with lock tabs extending therefrom and wherein said bottom wall has slots therein to receive said lock tabs, a U-shaped partition to divide the tray into compartments having a base and leg portions, said base of the partition lying adjacent the tray rear wall and the ends of the leg portions of the partition having tabs extending therefrom in opposite directions and inserted beneath the tray front wall lock flaps, a display poster attached to the container comprising a body panel with side panels extended therefrom and folded relative thereto, a bottom support panel extending from the main body panel, said side panels having locking tabs extending therefrom and in cooperating engagement with the tray adapted to be inserted between the tray side walls and the tray front wall end flaps to hold the display poster in an upright position.

2. A container as claimed in claim 1 wherein said side panels are provided with side flaps folded relative thereto and wherein the body panel is provided with a top flap foldable relative thereto.

3. A container comprising a tray portion and a cover portion, said cover portion being hingedly connected to said tray portion along a connecting fold line, said tray portion comprising a bottom wall, tray side walls, a tray front wall and a tray rear wall, said cover portion comprising a top wall, cover side walls and a cover front wall, the cover side walls terminating short of said connecting fold line, said top wall being provided with a top fold line parallel to and spaced from said connecting fold line to form a top rear portion, said cover side walls having outer edges tapering outwardly from said top fold line and end flaps extending therefrom and foldable relative thereto inwardly to lie adjacent said front cover wall, and said front cover wall having a flap extending therefrom and extending over said cover side wall end flaps, wherein said top rear portion is adapted to be folded backwardly to a position substantially adjacent and parallel to the outer surface of the tray rear wall, and said top wall folded about said top fold line beneath the bottom wall of the tray to support the same at an angle to a supporting surface along the outer edges of said cover side walls, a display poster attached to said tray portion comprising a body panel with side panels extending therefrom and folded relative thereto, a bottom support panel extending from the main body panel, said side panels having locking tabs extending therefrom adapted to be inserted between the tray side walls and the tray front wall end flaps adjacent the tray front wall in cooperating engagement with the tray to hold the display poster in an upright position.

* * * * *